US005109209A

United States Patent [19]

Ida et al.

[11] Patent Number: 5,109,209

[45] Date of Patent: Apr. 28, 1992

[54] IGNITION COIL DEVICE FOR ENGINE

[75] Inventors: Yasuhiko Ida; Bortman T. Jung, both of Saitama, Japan

[73] Assignee: Toyo Denso Kabushiki Kaisha, Tokyo, Japan

[21] Appl. No.: 689,998

[22] Filed: Apr. 23, 1991

[30] Foreign Application Priority Data

Apr. 28, 1990 [JP] Japan ..... 2-46351[U]
Apr. 28, 1990 [JP] Japan ..... 2-46352[U]

[51] Int. Cl.[5] ..... H01F 27/02

[52] U.S. Cl. ..... 336/96; 264/272.19; 336/192

[58] Field of Search ..... 361/424; 123/634; 264/272.14, 272.19; 336/96, 92, 205, 107, 192; 29/602.1

[56] References Cited

U.S. PATENT DOCUMENTS 4,403,403 9/1983 Hosoga et al. ..... 336/96
4,580,122 4/1986 Wörz ..... 336/205
4,918,419 4/1990 Ida ..... 336/96

*Primary Examiner*—Thomas J. Kozma
*Attorney, Agent, or Firm*—Lyon & Lyon

[57] ABSTRACT

Disclosed is an engine igniting coil device which comprises a plurality of coil units arranged in a case and unitarily potted therein with thermosetting resin, and is characterized by that a core portion of each coil unit is covered with a core cover, a coil base is mounted in the case to enclose portions of the core covers extruding from the coil case and inner space of the coil case is divided by partitions to separately accommodate coil units, thereby a required amount of resin for potting is reduced and thermal crack resistance of the resin potions is increased.

5 Claims, 10 Drawing Sheets

IGNITION COIL DEVICE FOR ENGINE

BACKGROUND OF THE INVENTION

The present invention relates to an engine igniting coil device.

Recently, there has been developed such an engine igniting coil device which comprises one coil case wherein a plurality of coil units selected in accordance with a quantity of engine cylinders are arranged with no use of a distributor and unitarily formed by potting with insulating material such as epoxy resin and the like.

In such an engine igniting coil device of prior art, as shown in FIG. 15, coil units 1, 2, 3 arranged in a coil case 5' are all embedded with resin 17 injected therearound. However, this method requires a large amount of resin 37 for potting the coils in the case 5' resulting in increase of the device's weight. Furthermore, since each of the coil units 1,2 and 3 has an exposed core portion 40 of closed magnetic circuit type which extrudes from a coil portion 41 wound thereon, the units may be potted with unevenly thick layers of resin in the case. Therefore, such a disadvantage is caused that thermal expansion and shrinkage of the core units 1,2 and 3 potted in the case create a stress concentrated on a thinner portion of resin layer whereat cracks may be easily formed.

In the prior art, a case 5' has a relatively large inner space in which a plurality of coil units 1, 2 and 3 are mounted and resin 37 is then poured to fill up the rest space portion thereof. An engine igniting coil device thus manufactured may not free from the possibility that its cured resin portion of the case 5' expands and shrinks by affection of thermal shock produced by change of surrounding temperature and may suffer cracking when a relatively large thermal distortion is applied thereon.

Furthermore, in case when a noise killer condenser is also potted in the ignition coil case for the purpose of preventing the noise from affecting audio-visual devices mounted in a vehicle for which the ignition coil device is used, it may be easily damaged under the thermal stress applied thereon through the surrounding layer of resin.

SUMMARY OF THE INVENTION

In view of the prior art described above, including the disadvantages of prior art ignition coil device comprising a coil case wherein a plurality of coil units unitarily potted with resin, it is an object of the present invention to provide an engine igniting coil device which is light in weight with reduced amount of resin injected therein and also has high strength against thermal stress cracking because of evenly thick resin layer formed around each of the coil units not to allow the partial concentration of thermal stress.

It is another object of the present invention to provide an engine igniting coil device which attains an improved strength against thermal stress cracking by minimizing the thermal distortion of its resin portion when a thermal shock being applied thereon.

In is further object of the present invention to provide an engine igniting coil device which is capable of including a noise killing condenser in its coil case in an optimum state eliminating the possibility to be damaged by thermal stress.

Figure 1:
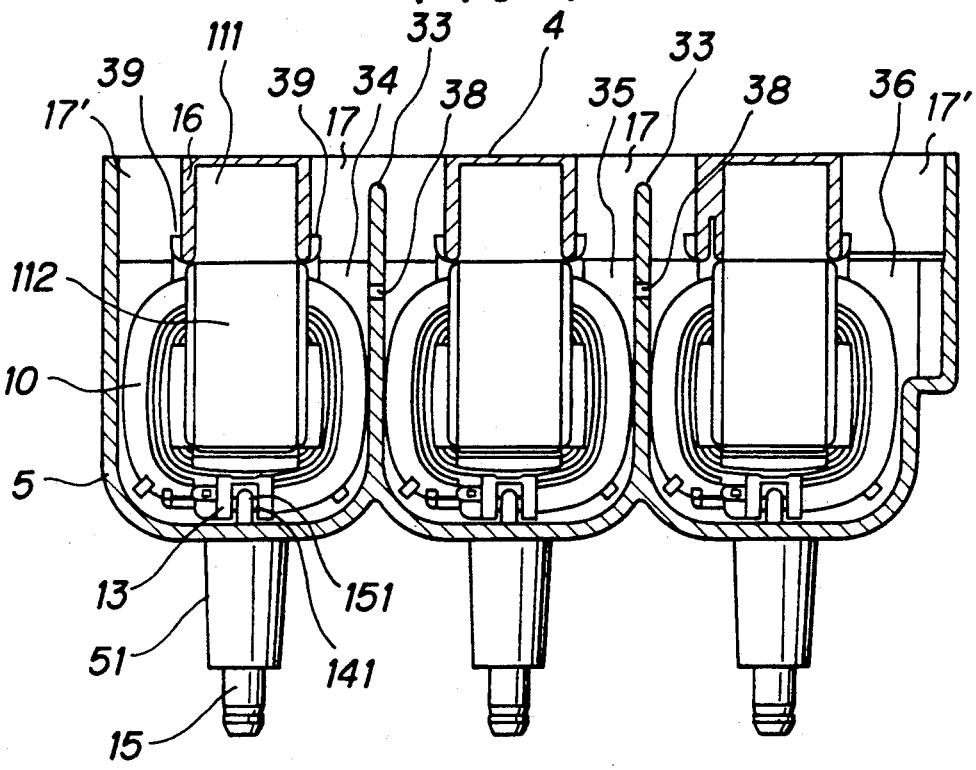
FIG. 1 is an elevational view in section of an engine igniting coil device embodying the present invention.

In the drawings, 1, 2 and 3 are coil units, 4 is a coil base, 5 is a coil case, 7 is a primary coil, 71 is a coil wire, 9 is a secondary coil, 111 and 112 are core covers, 16 is enclosed portion, 18 is a noise killer condenser, 37 is a resin, 39, 39F, 39B are protruding portion and 42 is a storage space.

DESCRIPTION OF THE PREFERRED EMBODIMENTS

An embodiment of the present invention will now be described in detail by way of example and with reference to the accompanying drawings.

Figure 6:
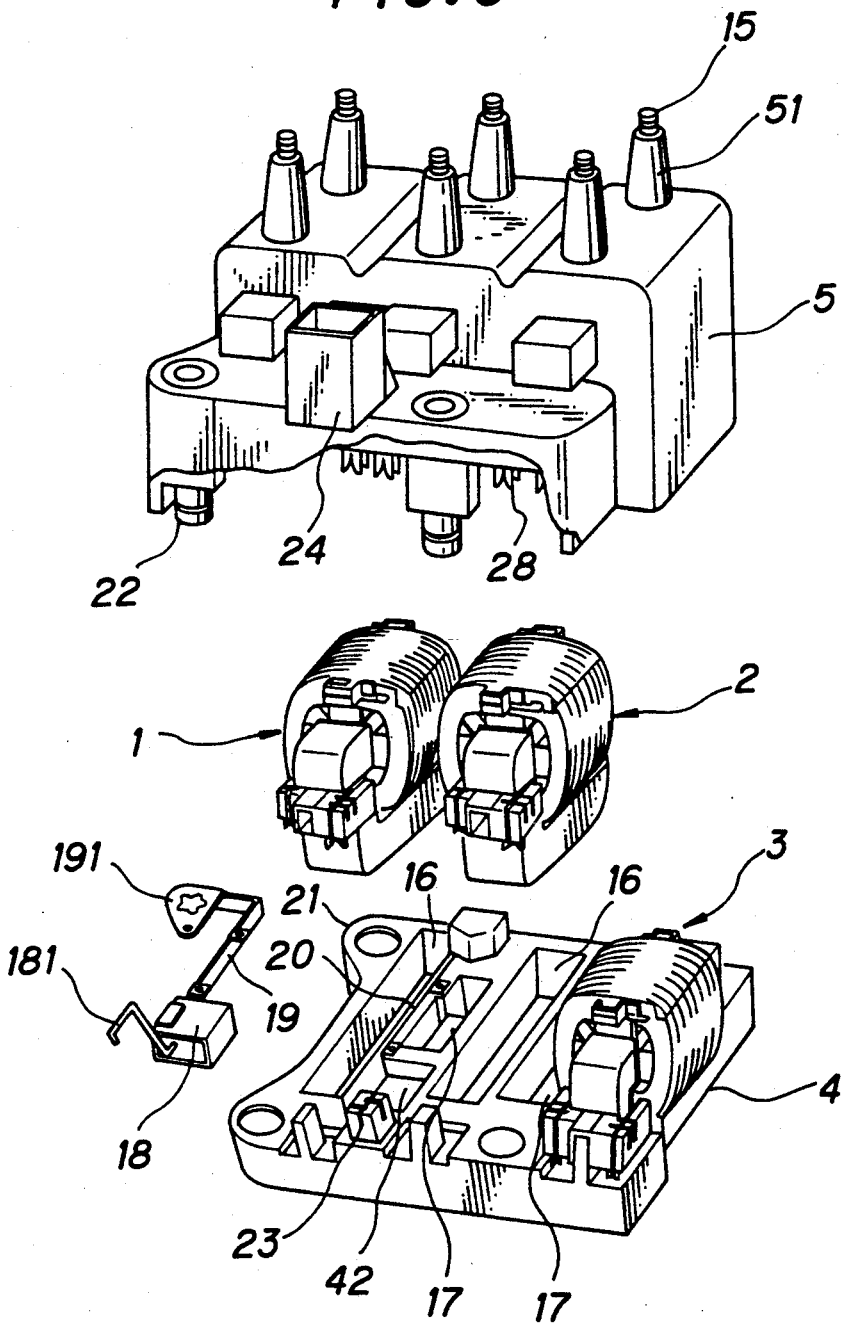
FIG. 6 is a perspective exploded view of an engine igniting coil device according to the present invention.
Figure 7:
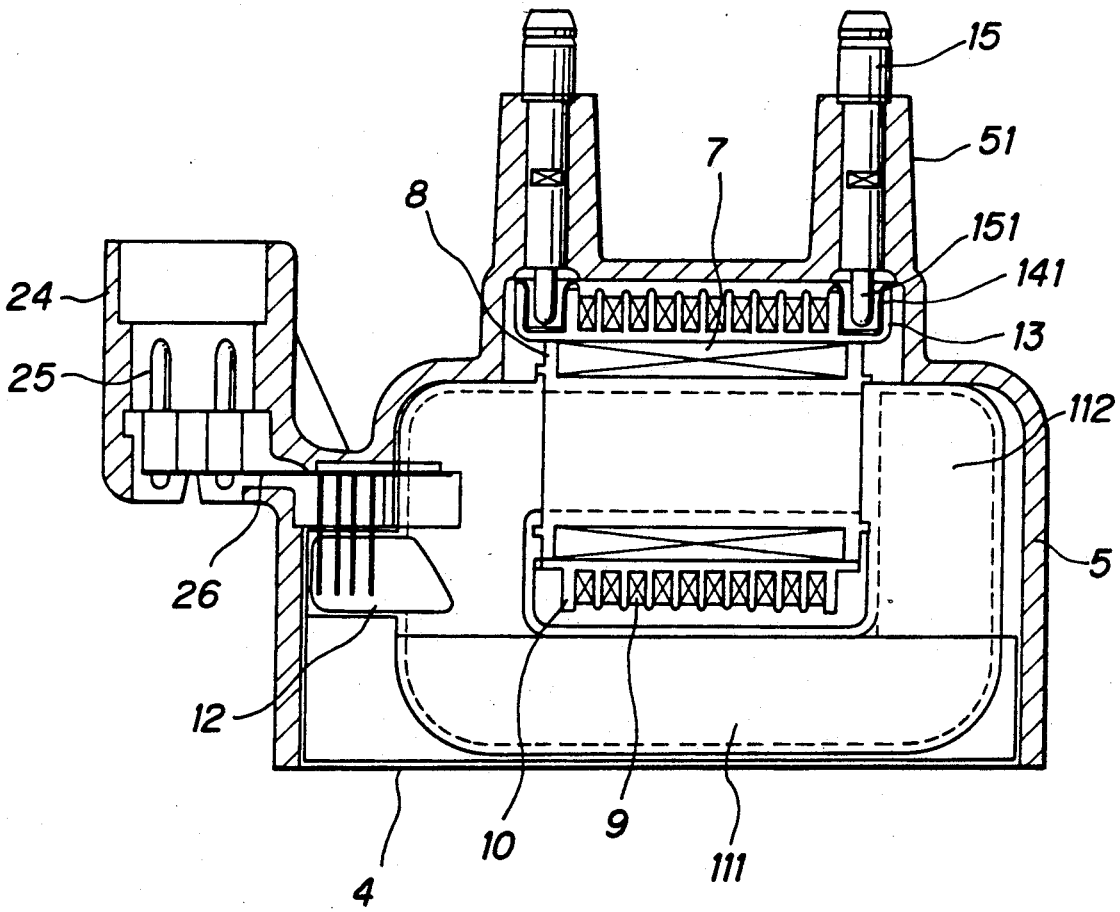
FIG. 7 is a sectional side elevation of the engine igniting coil device shown in FIG. 6.

As shown in FIGS. 6 and 7, an engine igniting coil device according to the present invention comprises tree coil units 1, 2 and 3 arranged in parallel to each other on a coil base 4 and a coil case 5 placed on the coil base, all of which is unitarily formed with insulating thermosetting resin, e.g. epoxy resin, injected to fill up the rest of the inner space of the coil case.

Figure 8:
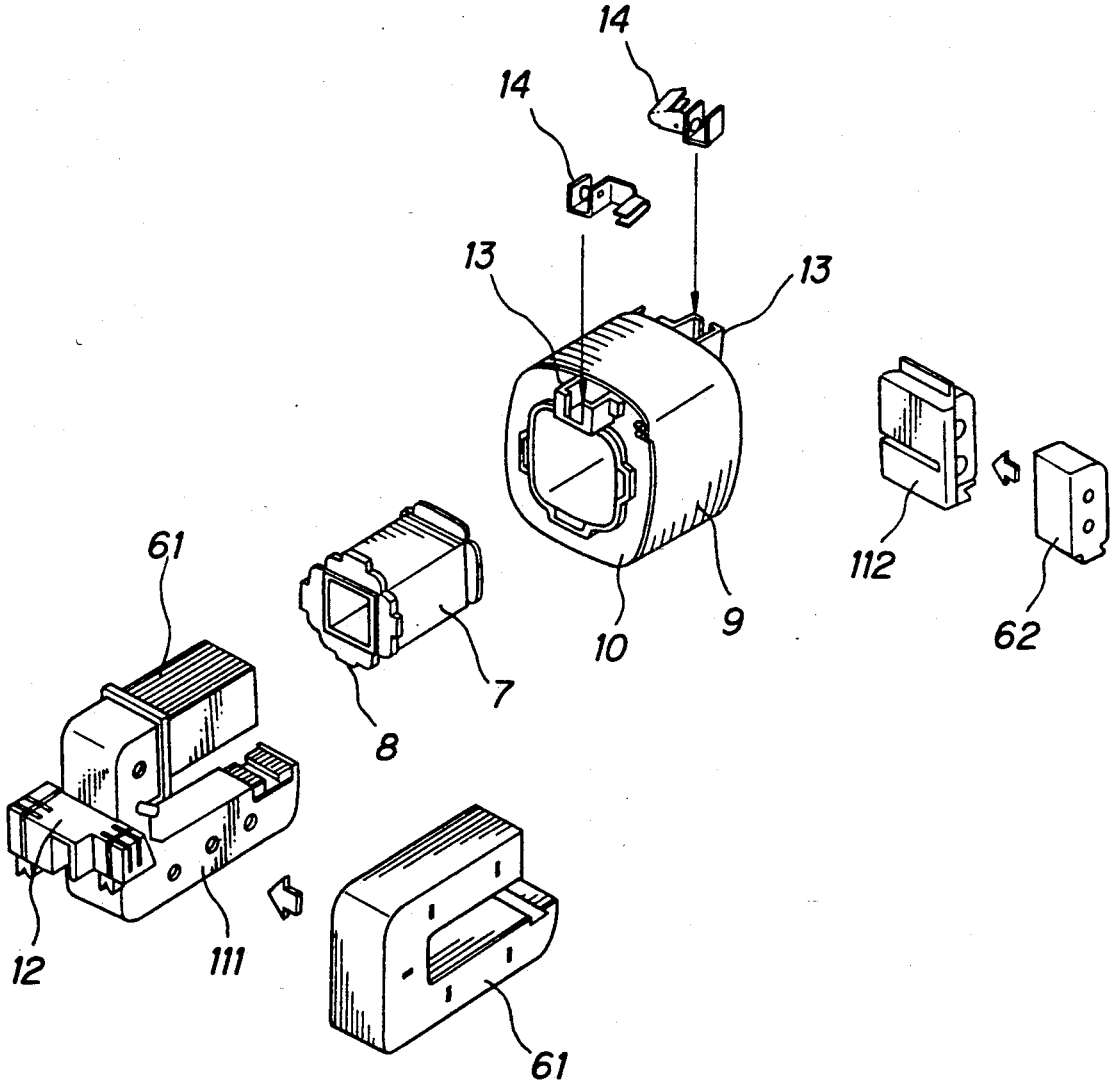
FIG. 8 is a exploded perspective view of a coil unit.

Each of coil units 1, 2 and 3 is constructed as shown in FIG. 8.

A primary side bobbin 8 with a primary coil 7 wound thereon is fitted onto an arm of a C-type core 61, and furthermore a secondary side bobbin 10 with a secondary coil 9 wounded thereon is fitted over the primary bobbin 8.

The C-type core 61 is housed in a core cover 111 in such a way that one of its arms may exposed out of the core cover for fitting thereon the primary side bobbin 8.

A I-type core 62 placed in a core cover 112 is fitted with pressure onto the open arm end of the C-type core to form a closed magnetic circuit type core.

The core covers 111 and 112 are molded of a relatively flexible resin, e.g. polypropylene, capable to absorb thermal distortion caused in the cores 61 and 62.

Since thus formed cores 62 and 63 of enclosed magnetic circuit type are covered with the primary side bobbin and the core covers 112 and 112, thermal stress caused by thermal expansion and shrinkage of the internal cores 62 and 63 can not be transmitted to the surrounding resin portion which is therefore free from being cracked under the action of thermal stress.

The core cover 111 has a wire holder 12 integrally formed at its end for fixing ends of wires brought out from the primary and secondary coils respectively.

Terminal holders 13 are provided one each at both side flanges of the secondary side bobbin and each of them accommodates a secondary terminal 14.

Figure 9:
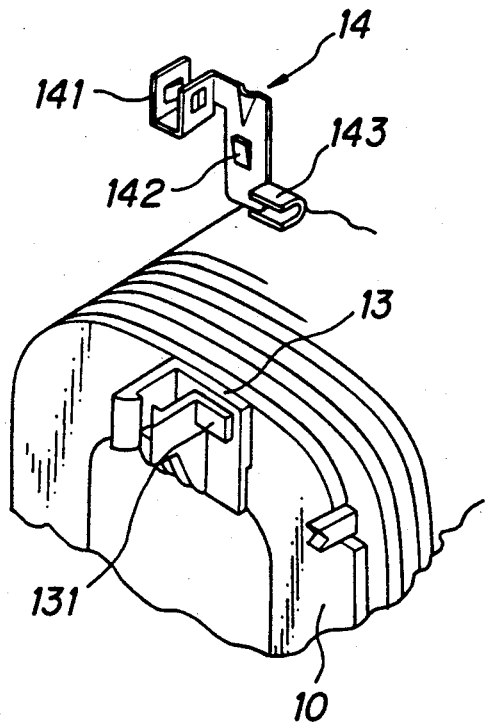
FIG. 9 a perspective view of a secondary terminal holder integrally provided at a secondary terminal and secondary bobbin side.
Figure 10:
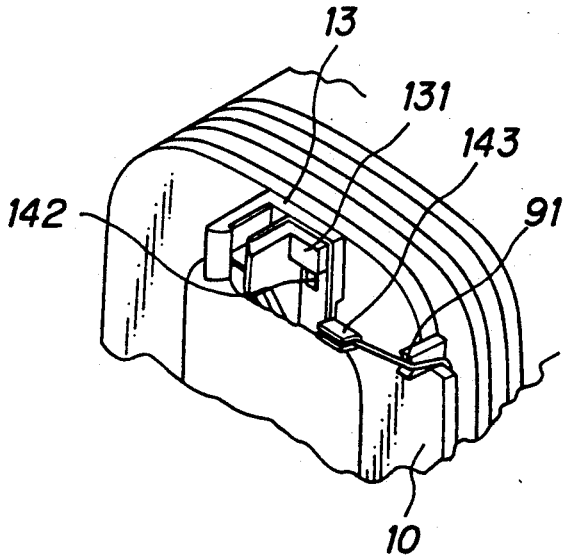
FIG. 10 is a perspective view of a secondary terminal mounted in a secondary terminal holder.

Each of secondary terminals 14, as shown in FIGS. 9 and 10, is locked at its lug portion 142 to a stepped portion of the terminal holder 131 when the secondary terminal 14 is inserted in the terminal holder 13.

Secondary terminal pins 15 are pressed in the coil case through corresponding bosses 51 of the coil case 5 in such a way so as to project their plug portions 151 in the case.

Each secondary terminal 14 has an integrally formed socket portion 141 being resilient to cooperate with the plug portion 151 of the corresponding terminal pin 14, and electrical connections of coil units becomes to be effective when the plug portions 151 of the secondary terminal pins 15 are inserted into the socket portions 141 of the secondary terminals as shown in FIGS. 1 and 7.

Each secondary terminal 14 is provided with a connecting portion 143 whereto a lead wire 91 of the secondary coil 9 is attached by electrically soldering or the like method.

The coil base 4 has three enclosed channel portions 16 for accommodating therein the exposed portions of the core covers 111 of coil units 1, 2 and 3, that is, the exposed portion of each core cover 111 extruding out of the coil case 5 is enclosed in the corresponding enclosed channel portion 16 of the coil base 4 as shown in FIG. 1.

The coil base 4 have also open ports 17 for injecting resin into the coil case 5.

The coil base also provides a space 42 for accommodating a noise killer condenser 18 for preventing the ignition coil device from giving a noise to audio-visual devices mounted in a vehicle.

According to the present invention, it is possible to place the noise killer condenser 18 utilizing a dead space of the coil base 4.

Consequently, there is no need to provide a space for mounting said condenser 18 in the coil case 5, thereby it becomes possible to reduce the size of the coil case.

Accommodation of the noise killer condenser 18 in the space 42 of the coil base 4 is also effective to prevent the condenser 18 from being damaged by the action of thermal stress.

An earthing plate 19 of the condenser 18 is placed in a clearance 20 formed in the coil base 4 and its connecting end is placed on a collar mounting seat 21 of the coil base 4. When an electrically conductive collar 22 for connecting coil base 4 and the coil case 5 is pressed in the seat 21, an electrical connection is made through the contact between the collar 22 and the connecting end 191 of the earthing plate 19. The collar 22 is hollow so as to pass an electrically conductive bolt for securing to the vehicle body, thereby earthing is made.

A lead wire 181 of the condenser 18 is attached at its end to a wire holder 23 formed at the coil base 4.

A coupler 24 for the primary terminals is formed integrally at the coil case 5.

The coupler 24 incorporates four primary terminal pins corresponding to the coil units 1, 2 and 3, and terminal plates 26 as lead elements are attached one at each terminal pin. These terminal plates 26 are connected to corresponding coil wires from the primary coils of the coil units 1, 2 and 3 in the following way.

Figure 11:
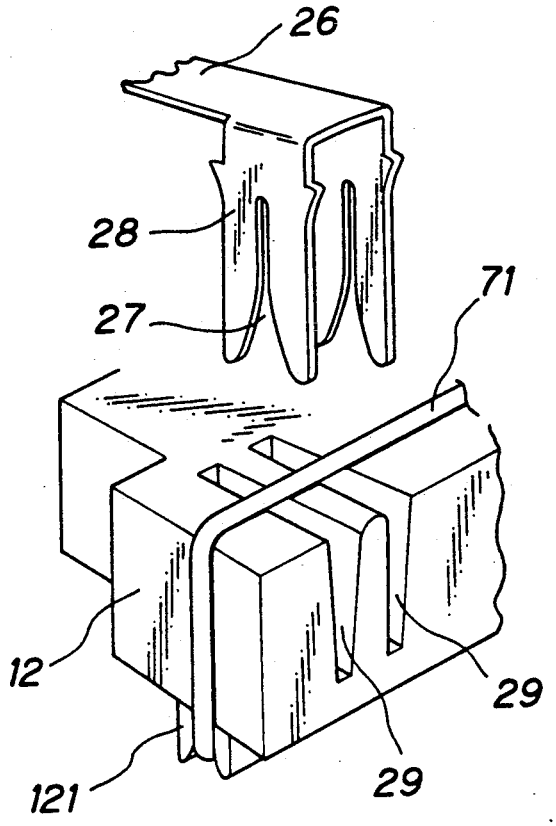
FIG. 11 is a perspective view of a bite type connecting portion formed at an end of a terminal plate for connection with a primary coil wire holder at a primary terminal side.
Figure 12:
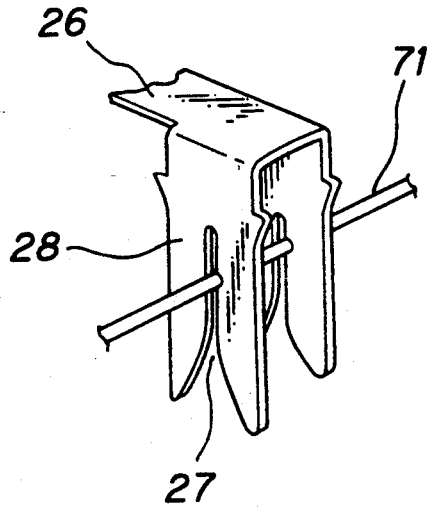
FIG. 12 is a perspective view wherein a bite type connecting portion is shown in the state engaging onto a wire taken-out from a primary coil.

As shown in FIG. 11, each terminal plate 26 has at its end a pair of connecting forks 28, each having two prongs forming therebetween a groove 27 which in its width at near bottom part is somewhat less than the diameter of the coil wire 71 to be fitted therein. An electrical connection can be set up between each terminal plate 26 and each coil wire 71 by thus fitting the coil wire 71 in the grooves 27 of two connecting forks 28 of the terminal plate 26.

Each wire holder 12 for each of the coil units 1, 2 and 3 has also two grooves and a coil wire taken-out from the corresponding primary coil 7 is secured to the wire holder 12 as being laid over two grooves.

When the coil base 4 with the coil units 1, 2 and 3 arranged thereon is covered with the coil case 5, the pairs of connecting forks 28 of the terminal plates 26 are inserted in the pairs of grooves 29 of the wire holders 12. At this time each of coil wires 71 secured to the corresponding wire holders 12 is forcibly fitted, as being stripped off, in the grooves 27 of the connecting forks 28 of the corresponding terminal plate 26 as shown in FIG. 11, thereby both sides are electrically connected with each other.

Figure 13A:
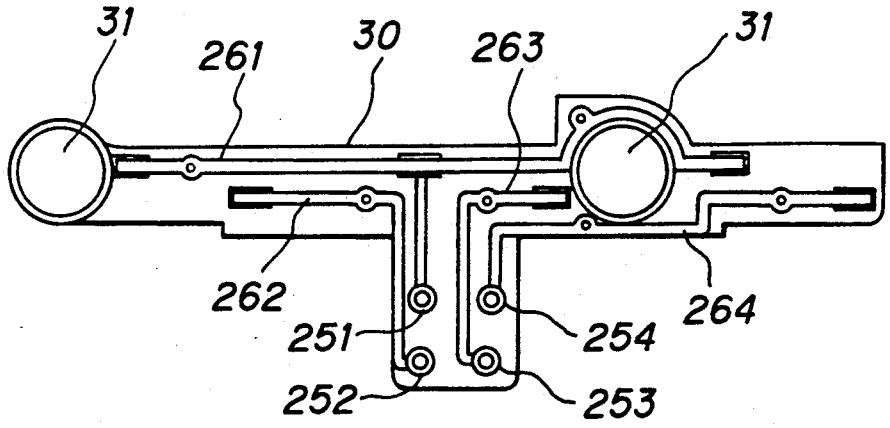
FIGS. 13(*a*) and (*b*) are views in plan and elevation, respectively, of a terminal plate mounted on a terminal base.
Figure 13B:
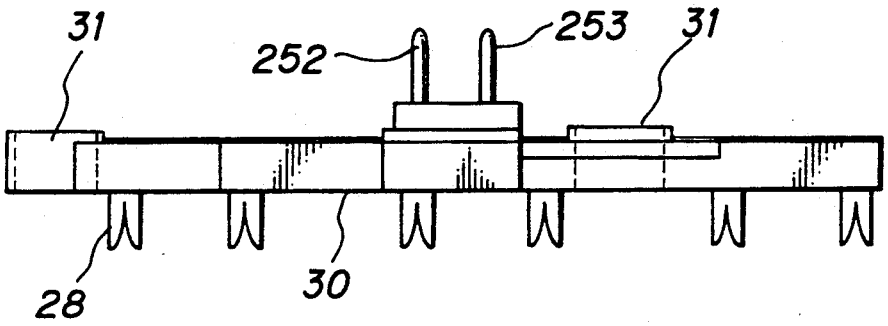

Four terminal pins 25 (251–254) and their terminal plates 26 (261–264) are arranged on the terminal base 30 as shown in FIG. 13 wherein through holes 31 are also provided for inserting therethrough collars 22. This terminal base 30 is incorporated in a given portion of the coil case 5.

Figure 14:
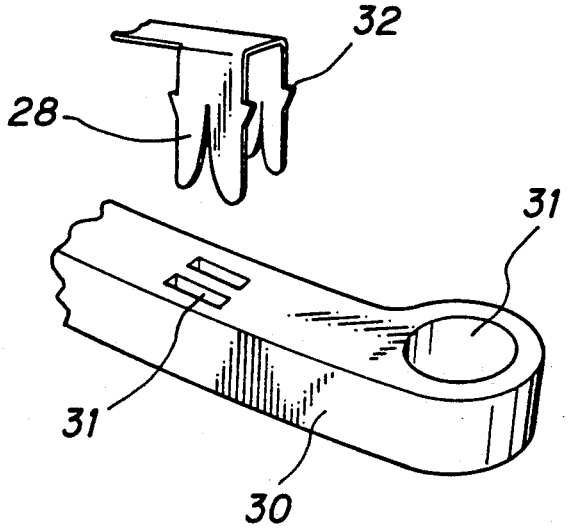
FIG. 14 is a perspective view of a forked connecting portions and a portion of terminal base.
Figure 15:
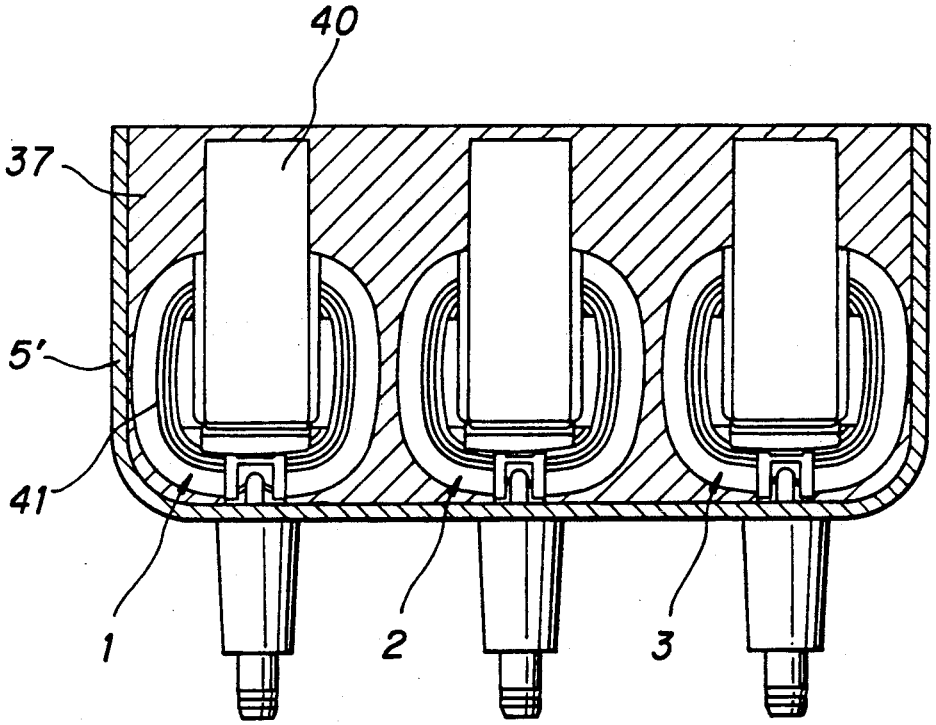
PRIOR ART FIG. 15
FIG. 15 illustrates in vertical elevation an engine igniting coil device of prior art.

The terminal base 30 has pairs of through holes 31 for insertion of pairs of connecting forks 28 of the terminal plates 26. As shown in FIG. 14, the forked portions 28 has protrusions 32 which engages with the bottom surface of the terminal base 30 to temporally secure the terminal plate 26 to the terminal base when the paired connecting forks 28 are inserted into the paired through holes 31 of the terminal base 30.

A terminal pin 251 and a terminal plate 261 connected to the terminal pin 251 serves commonly for the coil units 1, 2 and 3. The commonly used terminal plate 261 may be connected at the grooves 27 of its paired connecting forks 28 to a lead wire 181 of the condenser 18 to form an electrical connection in the same way as described above.

Figure 2:
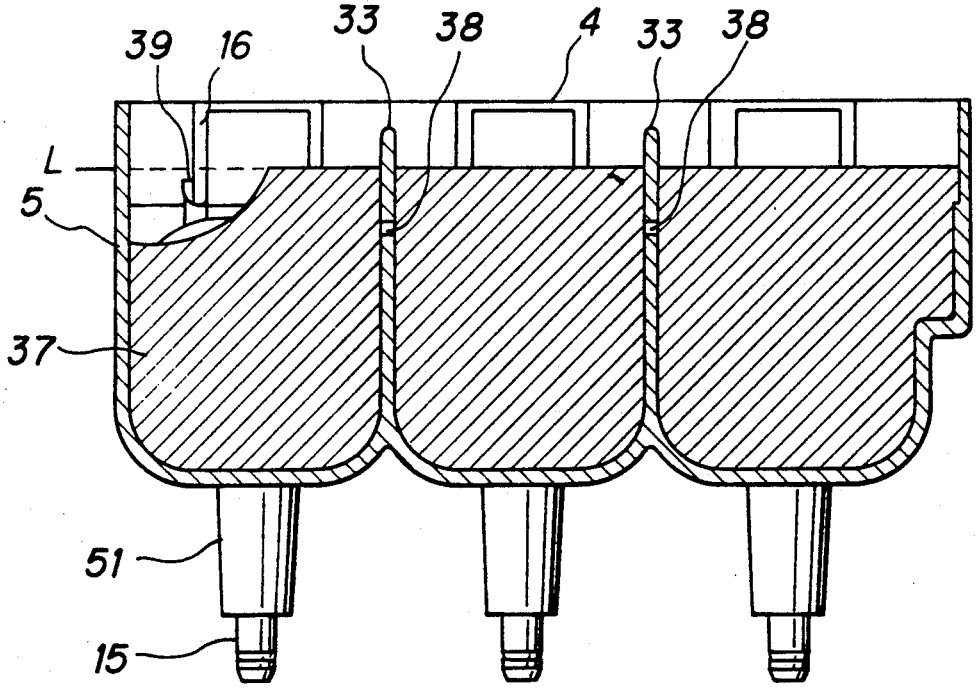
FIG. 2 is an elevational view in section of an engine igniting coil device when it is filled up with resin.

Referring now to FIG. 1, an engine ignition coil device according to the present invention is constructed in such that three coil units 1, 2 and 3 are incorporated respectively in compartments 34, 35 and 36 separated from each other by partitions 33 integrally formed in the coil case 5. When the coil base 4 and the coil case 5 are assembled with each other as shown in FIG. 2, resin is injected into the separate compartments of the coil case 5 to unitarily form all components in one ignition coil device.

As be apparent from FIG. 1, since each of compartments 34, 35 and 36 of the coil case is potted separately with resin 37, i.e., three resin portions separated from each other by the partitions 33 are formed in the coil case 5, expansion and shrinkage of the resin 37 under the action of thermal shock with a change of surrounding temperature may produce a thermal distortion which, however, can be well distributed and, therefore, can not concentrically increase to form cracks in the resin portions 37.

Figure 3:
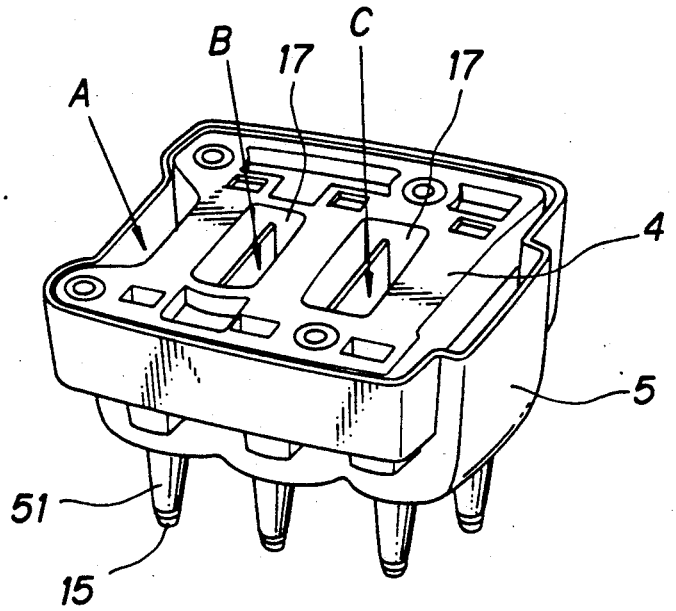
FIG. 3 is a perspective view of the same embodiment of the present invention as shown in FIGS. 1 and 2.

According to the present invention, such provision is also made that melt resin injected in the separate compartments 34, 35 and 36 may flow into the neighbor compartment through an open slit 38 formed in each partition 33. Consequently, when melt resin is injected in separate compartments 34, 35 and 46 of the coil case 4 through the injection ports A, B and C, respectively, of the coil base 4 mounted in the coil case 4 as shown in FIG. 3, levels of melt resin in three compartments 34, 35 and 36 can become equal to each other because of transferring melt resin between the compartments.

The embodiment of the present invention is also featured by that the coil case 5 is filled up with resin 37 not fully but to a mean level "L" in enclosed portions 16 of the coil base 4.

The portion of the core cover 111 of each coil unit, which is exposed out of the resin portion 37, is entirely enclosed in the enclosing portion 16 of the coil base 4 with complete water-tightness ensured.

If resin, e.g. epoxy resin would be injected into the coil case 5 directly without using the coil base to the mean level of core covers 111 made of PP resin as afore mentioned, the required water-tight connection could not obtained because the PP resin of the core cover and the epoxy resin have not affinity for each other and therefore poor adhesion is resulted.

In view of the above-mentioned, the coil case 5 and the coil base 4 of the device according to the present invention are made of materials having affinity for the potting resin such as epoxy or the like.

According to the present invention, it is possible to make the device lighter by reducing the amount of the resin injected into the coil case 5 assuring enough water-tightness of the device.

It is also possible to obtain even thickness of resin portions covering the coil units by virtue of reducing thickness of the resin portions covering the core covers 111.

Consequently, such a possibility is eliminated that, as mentioned afore, thermal stresses concentrate on the resin portion having a relatively larger variation in thickness to create cracks therein.

Figure 4:
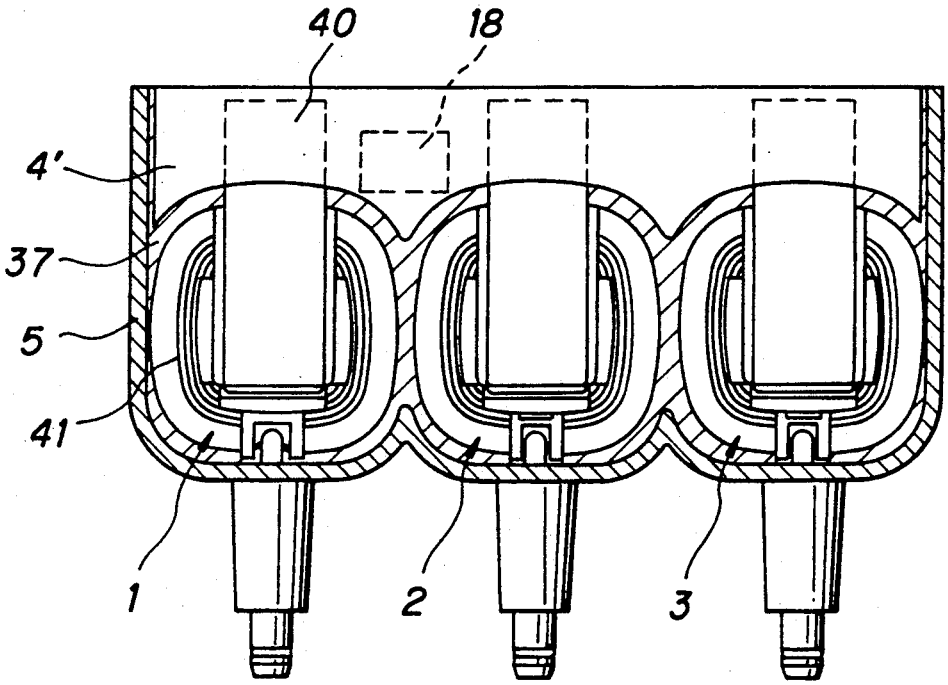
FIG. 4 is an elevational view in section of another example of engine igniting coil device according to the present invention.

FIG. 4 shows another embodiment of the present invention, wherein a coil base 4' including cores 40 partially fitted therein and having an inner surface conforming to surfaces of coils 41 enough to keep an even clearance therebetween is mounted in a coil case 5, thereby creation of evenly thick resin portion 37 surrounding all coils' circumference is assured. The coil base 4' has resin injecting ports (not shown) and also includes a noise killer condenser 18.

In this case, since it is required to fill the space in the coil case to the inner surface of the coil base 4', amount of the resin 37 to be injected may be so much reduced to effectively realize weight reduction of the device.

According to the present invention, it is also proposed to provide resin injecting ports 17 and 17' with protrusions 39 for indicating a control level of resin injection.

The melt resin is injected into the coil case 5 through the resin injection ports 17 and 17' until the protrusions 39 in the ports just disappear in the melt resin injected, and thus the required amount of resin injected in the coil case can be obtained.

In case when the resin is injected into the coil base to the level lower than the upper surface of the coil base 4, the required level of resin injection may be easily and visually checked by the protrusions in the injection ports.

Figure 5:
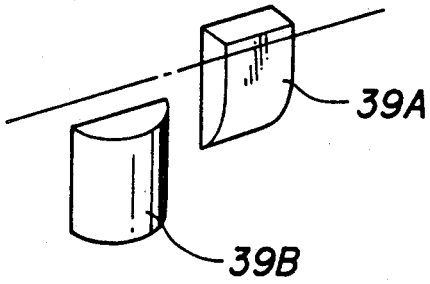
FIG. 5 shows an example of marks for indicating a necessary level of resin filling.

FIG. 5 shows, by way of example, another level control indicator which comprises a pair of protruded marks, i.e. a mark 39A for upper limit level and a mark 39B for lower limit level. The melt resin is injected into the coil case 5 until the upper surface of injected resin reaches a level between the upper and the lower protruded marks in the injection ports, i.e., the lower mark 39A is disappears but the upper mark 39B is still visible, thus ensuring the required level of resin injection.

As be apparent from the foregoing description, the engine igniting coil device according to the present invention has such an advantage that since a coil case with a plurality of coil units arranged therein is covered with a coil base and all of them unitarily formed by injecting melt resin into the coil case upto the middle of enclosed portions of the coil base covering exposed ends of coil cores of the coil units, the required amount of the resin can be reduced so as to effectively reduce weight of the device without deterioration of its water-tightness and, furthermore, the evenly thick resin portion can be formed surrounding the coil units in the coil case so as to eliminate the possibility to produce cracks in a thinner resin portion due to a concentrated thereon thermal stress.

According to the present invention, since level control marks are provided in resin injection ports of the coil base, it is possible to reliably obtain the required amount of resin injection by easy visual checking on the level control marks.

According to the present invention, since a plurality of coil units are accommodated in separate compartments formed by partitions in the coil case, thermal distortion caused by thermal shock can be distributed dispersively to the separated resin portions, thereby the crack resistance of each resin portion can be effectively increased.

According to the present invention, since the melt resin injected in the separate compartments may flow into the neighbor compartment through an open slit 38 formed in each partition, the even level of the injected resin can be obtained in all compartments in the coil case.

According to the present invention, since a noise killer condenser is accommodated in a compartment formed in the coil base utilizing a dead space therein, the space factor is increased and the condenser may be free from being damaged by thermal stress.

What is claimed is:

1. An engine igniting coil device comprising:

a plurality of coil units, each coil unit consisting of a core with a primary and a secondary coils wound thereon; a coil case including the coil units arranged therein; and an insulating portion of resin injected into the coil case for unitarily potting the coil units therein, characterized in that an exposed portion of each coil unit is covered by a core cover having an exposed portion extruding from the coil case; a coil base enclosing exposed portions of all core covers is mounted in the coil case; and the insulating portion of resin is injected into the coil case through injecting ports formed in the coil base to the middle height of the enclosed portions.

2. An engine igniting coil device as claimed in claim 1, characterized in that a level control mark is provided in each resin injection portion in the coil base.

3. An engine igniting coil device as claimed in claim 1, characterized in that the inner space of the coil case is divided by partitions to form separate compartments for accommodating the coil units one in each.

4. An engine igniting coil device as claimed in claim 3, characterized in that the partitions of the separate compartments for separately accommodating the coil units have an open slits for allowing the resin to flow into the next compartments.

5. An engine igniting coil device as claimed in claim 1, characterized in that the coil base has a compartment for accommodating a noise killer condenser therein.

* * * * *